US007320576B2

(12) United States Patent
Enomoto et al.

(10) Patent No.: US 7,320,576 B2
(45) Date of Patent: Jan. 22, 2008

(54) CLUTCHLESS VARIABLE DISPLACEMENT REFRIGERANT COMPRESSOR WITH MECHANISM FOR REDUCING DISPLACEMENT WORK AT INCREASED DRIVEN SPEED DURING NON-OPERATION OF REFRIGERATING SYSTEM INCLUDING THE COMPRESSOR

(75) Inventors: Anri Enomoto, Isesaki (JP); Yoshihiro Ochiai, Isesaki (JP)

(73) Assignee: Sanden Corporation, Gunma (JP)

( * ) Notice: Subject to any disclaimer, the term of this patent is extended or adjusted under 35 U.S.C. 154(b) by 614 days.

(21) Appl. No.: 10/647,218

(22) Filed: Aug. 26, 2003

(65) Prior Publication Data

US 2004/0076527 A1 Apr. 22, 2004

(30) Foreign Application Priority Data

Aug. 27, 2002 (JP) ..... 2002/247273

(51) Int. Cl.
*F04B 1/12* (2006.01)
*F04B 1/26* (2006.01)

(52) U.S. Cl. ..... 417/269; 417/222.1; 417/222.2

(58) Field of Classification Search ..... 417/221.1, 417/269, 222, 222.1, 222.2; 92/12.1, 12.2, 92/13.1, 13.2
See application file for complete search history.

(56) References Cited

U.S. PATENT DOCUMENTS

| | | | | |
|---|---|---|---|---|
| 4,502,844 A | | 3/1985 | Kimura | 417/275 |
| 4,586,874 A | | 5/1986 | Hiraga | 417/222 |
| 4,842,488 A | | 6/1989 | Terauchi | 417/222 |
| 4,874,295 A | | 10/1989 | Kobayashi | 417/222 |
| 4,880,360 A | | 11/1989 | Terauchi | 417/222 |
| 4,960,366 A | | 10/1990 | Higuchi | 417/222 |
| 5,255,569 A | | 10/1993 | Terauchi | 74/60 |
| 5,513,553 A | * | 5/1996 | Gleasman et al. | 92/12.2 |
| 5,573,379 A | | 11/1996 | Kimura | 417/222.2 |
| 5,624,240 A | * | 4/1997 | Kawaguchi et al. | 417/222.2 |
| 5,704,769 A | * | 1/1998 | Michiyuki et al. | 417/269 |
| 5,865,604 A | * | 2/1999 | Kawaguchi et al. | 417/222.2 |
| 5,983,775 A | | 11/1999 | Fukai | 92/12.2 |
| 6,102,669 A | | 8/2000 | Fujita | 417/222.2 |
| 6,179,572 B1 | | 1/2001 | Taguchi | 417/222.2 |
| 6,589,019 B2 | | 7/2003 | Terauchi | 417/63 |
| 6,684,655 B2 | | 2/2004 | Terauchi | 62/228.5 |
| 2003/0095874 A1 | | 5/2003 | Tagami | 417/222.1 |

* cited by examiner

*Primary Examiner*—Anthony D. Stashick
*Assistant Examiner*—Jessica L Frantz
(74) *Attorney, Agent, or Firm*—Baker Botts LLP

(57) ABSTRACT

In a variable displacement swash plate type refrigerant compressor (10), a stopper (28) is provided for setting an initial angle of the inclination angle of a swash plate (23) when a drive shaft (19) is not driven. When the drive shaft (19) is driven by a driving power source of the compressor (10) under a non-operation condition of a refrigerant circuit, the stopper (28) is moved to permit the inclination angle of the swash plate (23) to be reduced from the initial angle in response to increase of compression work of the compressor (10) so as to suppress the increase of the compression work to save the driving power for the compressor (10).

14 Claims, 5 Drawing Sheets

CLUTCHLESS VARIABLE DISPLACEMENT REFRIGERANT COMPRESSOR WITH MECHANISM FOR REDUCING DISPLACEMENT WORK AT INCREASED DRIVEN SPEED DURING NON-OPERATION OF REFRIGERATING SYSTEM INCLUDING THE COMPRESSOR

BACKGROUND OR THE INVENTION

This invention relates to a clutchless refrigerant compressor of a variable displacement type and, in particular, to an improvement for reducing a compression work in the clutchless refrigerant compressor during a stop of a refrigerating system including the clutchless refrigerant compressor.

PRIOR ART

A typical clutchless refrigerant compressor of a variable displacement type or a variable capacity type is disclosed in U.S. Pat. No. 5,573,379 (corresponding to JP 07 293429A). The clutchless refrigerant compressor shown therein is typically a swash plate type wherein a swash plate is coupled to a drive shaft with a inclination angle from a plane perpendicular to the drive shaft, the inclination angle being variable between a predetermined maximum angle and a predetermined minimum angle approximately equal to the zero angle. The swash plate is coupled to pistons fitted in cylinder bores and reciprocates the pistons in the cylinder bores by rotation with the inclination angle. The piston stroke is determined by the inclination angle and is the maximum stroke when the inclination angle is the predetermined maximum angle while being minimum when the inclination angle is the predetermined minimum angle. The inclination angle of the swash plate is changed by change of gas pressure within a crank chamber where the swash plate is disposed. A capacity control valve is used for controlling the gas pressure for adjusting the inclination angle of the swash plate to control the compression capacity of the compressor. In order to couple the swash plate to pistons, a conversion mechanism is used for converting nutating motion of the swash plate to reciprocating motion of the pistons. As the conversion mechanism, two types are known in the art, one is a type using a wobble plate connected to pistons and supported non-rotatably but slidable on the swash plate, and the other is a shoe type where two semi-spherical shoes are supported by pistons and are in slidable contact with both surfaces of the swash plate.

The clutchless refrigerant compressor of the variable displacement type is usually used for a refrigerant compressor in a refrigerating circuit in an automotive air conditioner. The drive shaft is connected to an automotive engine output through a belt and a pulley without electromagnetic clutch. Therefore, the drive shaft is rotated or stopped when the engine is driven or stopped.

The compressor is designed so that the swash plate is held in the predetermined minimum angle when the drive shaft is stopped. It is desired that the inclination angle is smoothly and rapidly increased from the predetermined minimum angle when the engine starts to drive the drive shaft. In order to meet the desire, U.S. Pat. No. 5,573,379 discloses that the swash plate is designed to generate a moment for moving the swash plate to increase the inclination angle when the swash plate is started to rotate at the minimum inclination angle. Thus, the compression capacity is smoothly and rapidly increased to an appropriate level for providing comfortable air condition.

However, there is often a case where the air conditioning system is switched off even when the automotive vehicle is driven. In the case, the drive shaft is rotated even when the refrigerating circuit of the air conditioning system is in the off operation. The drive shaft rotation results in increase of the inclination angle of the swash plate by the U.S. Patent indicted above. This means that unnecessary compression work is carried out to waste the engine output.

SUMMARY OF THE INVENTION

Accordingly, it is an object to provide a clutchless refrigerant compressor of a variable displacement type where the compression work is reduced when the drive shaft of the compressor is driven during an off-condition of a refrigerating circuit including the compressor.

It is another object to provide a clutchless refrigerant compressor of a variable displacement type having the smooth and rapid starting property as well as realizing the above object.

This invention is applicable to a clutchless refrigerant compressor of a variable displacement type comprising: a compressor housing having therein a crank chamber, at least one cylinder bore, a suction chamber, and a discharge chamber, said suction chamber and a discharge chamber having an inlet port and an outlet port, respectively, for connecting the compressor to a refrigerating circuit; at least one piston fitted into said at least one cylinder bore and being reciprocate within said cylinder bore; a drive shaft extending in the crank chamber in a direction parallel to said cylinder and said piston and rotatably born in the compressor housing, said drive shaft having an axial end portion protruding outward from the compressor housing, said axial end portion being for connecting an external driving source for receiving a driving power to rotate said drive shaft; a rotor fixedly mounted on said drive shaft within said crank chamber to be rotatable together with said drive shaft; a swash plate disposed around said drive shaft and connected to said rotor by a hinge connection at an angular position, as a hinge angular position, around said drive shaft so as to be rotatable together with said rotor and to be able to inclined from a plane perpendicular to a drive axis of said drive shaft, said swash plate making a nutating motion with an inclination angle by rotation together with said rotor, the inclination angle of said swash plate being variable between a predetermined minimum angle approximately equal to a zero angle and a predetermined maximum angle; an urging member providing an urging force to urge said swash plate so that said inclination angle of said swash plate becomes the predetermined minimum angle; a connecting mechanism connecting said swash plate to said piston for converting said nutating motion of said swash plate to reciprocating motion of said piston; and a control mechanism for controlling said inclination angle of said swash plate together or against said urging member by adjusting a pressure within said crank chamber to thereby control the displacement of said compressor.

According to this invention, the compressor further comprises: determining means for determining the inclination angle of the swash plate to an initial angle when said drive shaft is stopped without being driven by the external driving source, the initial angle being selected larger than the predetermined minimum angle; and releasing means for releasing the inclination angle determining means when compression work of the compressor is increased after said drive shaft is driven by the external driving source.

DESCRIPTION OF PREFERRED EMBODIMENTS

Figure 1:
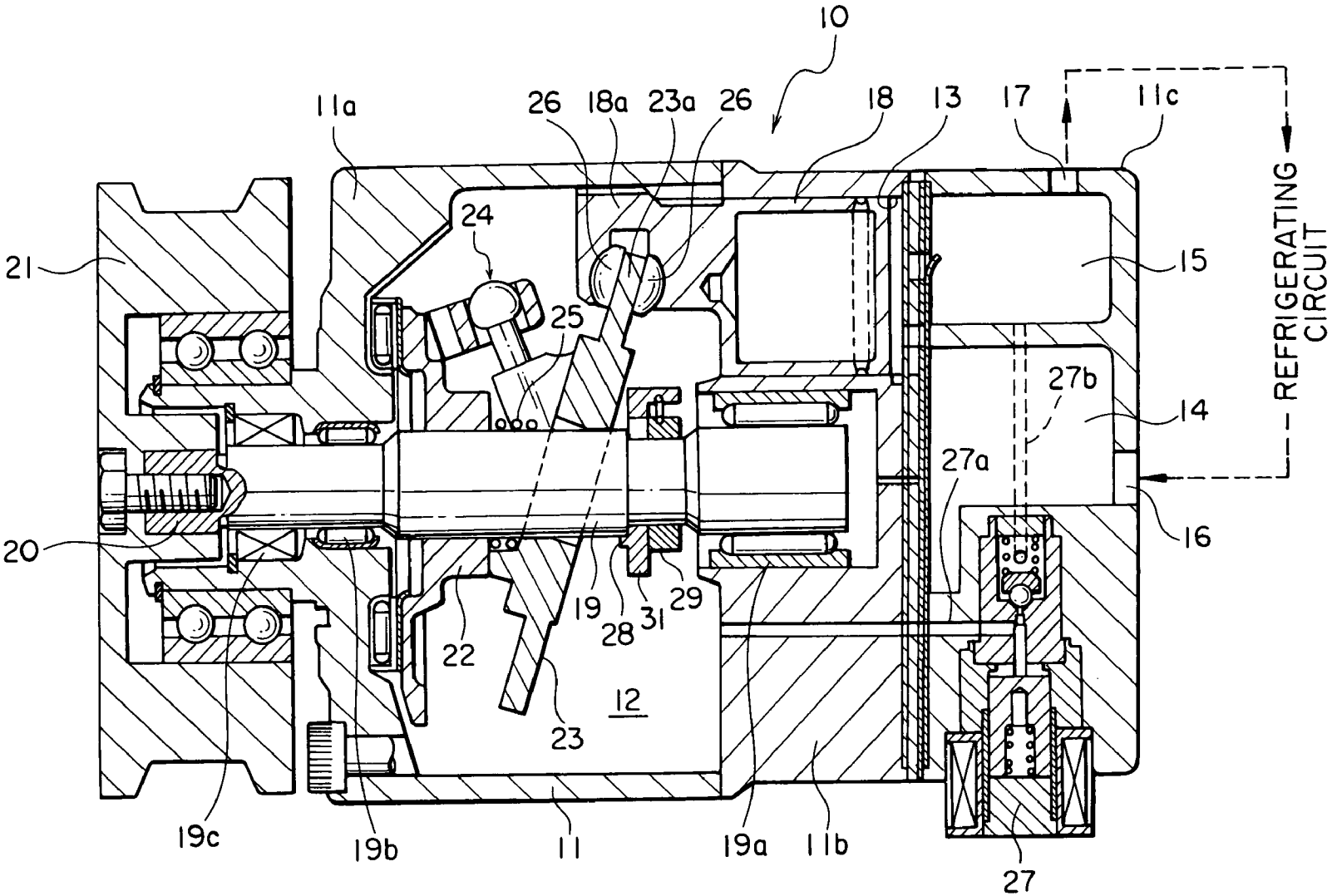
FIG. 1 is a sectional view of a compressor according to an embodiment of this invention.

Referring to FIG. 1, a clutchless refrigerant compressor 10 of a variable displacement type according to an embodiment of this invention will be described below. The compressor 10 comprises a compressor housing 11 comprising a front housing 11*a*, cylinder block 11*b* and a cylinder head 11*c*. The compressor housing 11 defines therein a crank chamber 12, a plurality of cylinder bores (one is shown) 13, a suction chamber 14, and a discharge chamber 15. The suction chamber 14 and a discharge chamber 15 have an inlet port 16 and an outlet port 17, respectively, for connecting the compressor 10 to a refrigerating circuit.

Pistons (one is shown) 18 are fitted into the cylinder bores 13 and reciprocated within the cylinder bores 13.

A drive shaft 19 extends in the crank chamber 12 in a direction parallel to the cylinder bores 13 and the pistons 18, and is rotatably born in the compressor housing 11 by bearings 19*a*-19*c*. The drive shaft 19 has an axial end portion 20 protruding outward from the front housing 11*a* of the compressor housing 11. The axial end portion 20 is for connecting an external driving source (not shown) for receiving a driving power to rotate the drive shaft 19 through a pulley 21 and a belt (not shown).

A rotor 22 is fixedly mounted on the drive shaft 19 within the crank chamber 12 and rotatable together with the drive shaft 19.

A swash plate 23 is disposed around the drive shaft 19 and connected to the rotor 22 by a hinge connection 24 at an angular position, as a hinge angular position, around the drive shaft 19. Accordingly, the swash plate 23 is rotatable together with the rotor 22 and is able to be inclined from a plane perpendicular to a drive axis of the drive shaft 19. The swash plate 23 performs a nutating motion with an inclination angle by rotation together with the rotor 22. The inclination angle of the swash plate 23 is variable between a predetermined minimum angle approximately equal to a zero angle and a predetermined maximum angle.

An urging member 25 is mounted around the drive shaft 19 between the rotor 22 and the swash plate 23 and provides an urging force A (see FIG. 2) to urge the swash plate 23 so that the inclination angle of the swash plate 23 becomes the predetermined minimum angle.

A connecting mechanism or a conversion mechanism connects the swash plate 23 to the pistons 18 for converting the nutating motion of the swash plate 23 to reciprocating motion of the pistons 18. The connecting mechanism comprises a peripheral edge portion 23*a* of the swash plate 23, a rear end portion 18*a* of each piston 18, and shoes 26 of semi-spherical shape. The shoes are in a sliding contact with both sides of the peripheral edge portion of the swash plate 23 and are held in the rear end portion 18*a* of the piston 18.

A control mechanism 27 including a control valve is contained in the cylinder head 11*c* for controlling the inclination angle of the swash plate 23 together or against the urging member 25 by adjusting a pressure within the crank chamber 12 to thereby control the displacement of the compressor 10. The control valve 27 is communicated with the crank chamber 12 through a first small path 27*a* and with discharge chamber 15 through a second small path 27*b*. The control valve 27 controls communication between the discharge chamber 15 and the crank chamber 12 through the first and second small paths 27*a* and 27*b* to thereby adjust the crank chamber 12.

The compressor 10 described above is similar to the compressor known in the prior art.

According to the present invention, the compressor 10 further comprises means for determining the inclination angle of the swash plate 23 to an initial angle (θ1) when the drive shaft 19 is stopped without being driven by the external driving source. The initial angle is selected larger than the predetermined minimum angle. The compressor 10 also comprises means for releasing the initial inclination angle determining means when compression work of the compressor 10 is increased after said drive shaft is driven by the external driving source.

As the initial inclination angle determining means, a stopper 28 is mounted on the drive shaft 19 at a predetermined position as an initial position on the drive axis of the drive shaft 19. The stopper 28 stops the swash plate 23 from changing in inclination due to the urging force A from the urging member 25 when the drive shaft 17 is not driven by the external driving source and maintains the swash plate 23 at a predetermined inclination angle as an initial angle. The stopper 28 is variable in the position on the drive axis. The initial angle is selectable to an angle larger than the predetermined minimum angle of the inclination angle of the swash plate 23.

The releasing means comprises a detector for detecting a physical factor corresponding to compression work of the compressor 10 and a driver connected to the detector and the stopper for, when the physical factor detected shows increase of the compression work, driving the stopper from the initial position in a direction of the drive axis to thereby permit the swash plate 23 to move from the initial angle to the predetermined minimum angle due to the urging force from the urging member 25.

The detector is a rotating speed sensor for sensing a rotating speed of the drive shaft, which results in the compression work of the compressor.

Figure 2:
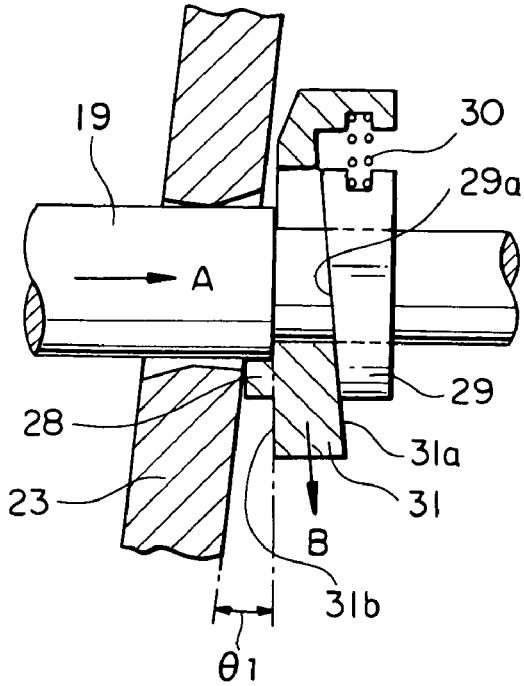
FIG. 2 is an enlarged partial sectional view illustrating a main portion in the compressor shown in FIG. 1 for determining initial inclination angle of a swash plate in an non-rotating condition of the swash plate.
Figure 3:
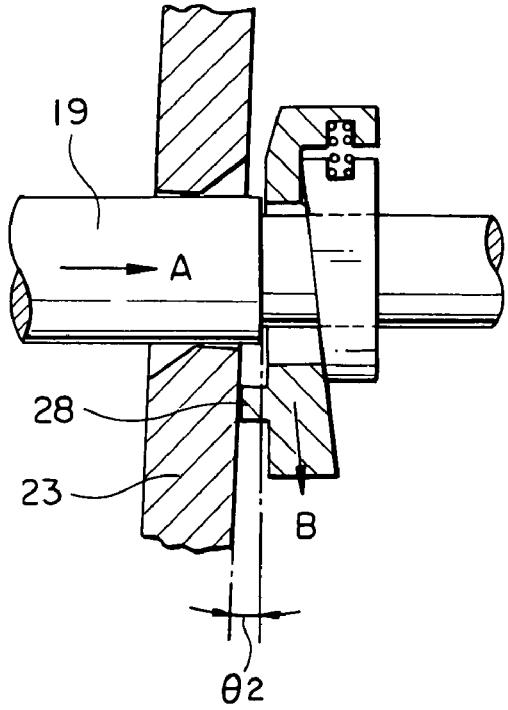
FIG. 3 is the sectional view illustrating the main portion of FIG. 2 illustrating a condition releasing the initial inclination angle when the swash plate is rotated with an increased rotating speed.

Referring to FIGS. 2 and 3, a fixed ring 29 is fixedly mounted on the drive shaft 19 at an axial position on a side opposite to the rotor 22 with respect to the swash plate 23. The fixed ring 29 has a side surface 29*a* facing the swash plate 23. The side surface 29*a* is inclined so that a first distance along the drive shaft 19 from the side surface 29*a* to the rotor 22 at the hinge angular position is smaller than a second distance along the drive shaft 19 from the side surface 29*a* to the rotor 22 at an angular position opposite to the hinge angular position. A wedge-like ring 31 having a wedge-shape section is disposed around the drive shaft 19 and is elastically supported by a spring 30 mounted on an outer surface of the fixed ring 29 at an angular position corresponding to the hinge angular position. The wedge-like ring 31 has a inclined side surface 31*a* corresponding to, and being in contact with, the side surface 29*a* of the fixed ring 29 and also has an opposite side surface 31*b*. The wedge-like ring 31 has an unbalanced weight around the drive shaft so that a weight is smaller at a half of the wedge-like ring 31 on the side of the hinge angular position than at the other half. As is seen in FIG. 3, the wedge-like ring 31 is diametrically moved along the side surface 29*a* of the fixed ring 29 to a direction toward the opposite side of the hinge angular position against the supporting force of the spring 30 by a centrifugal force (B) caused by rotation together with the drive shaft 19. The stopper 28 is formed as a protrusion at a position on the opposite side surface 31*b* of the wedge-like ring 31. The stopper 29 is moved away from the rotor 22 or backward in the direction of the drive axis by the movement of the wedge-shape ring 31 by the centrifugal force B. Thus, the spring 30 and the wedge-like ring 31 serves as the releasing means.

Figure 4:
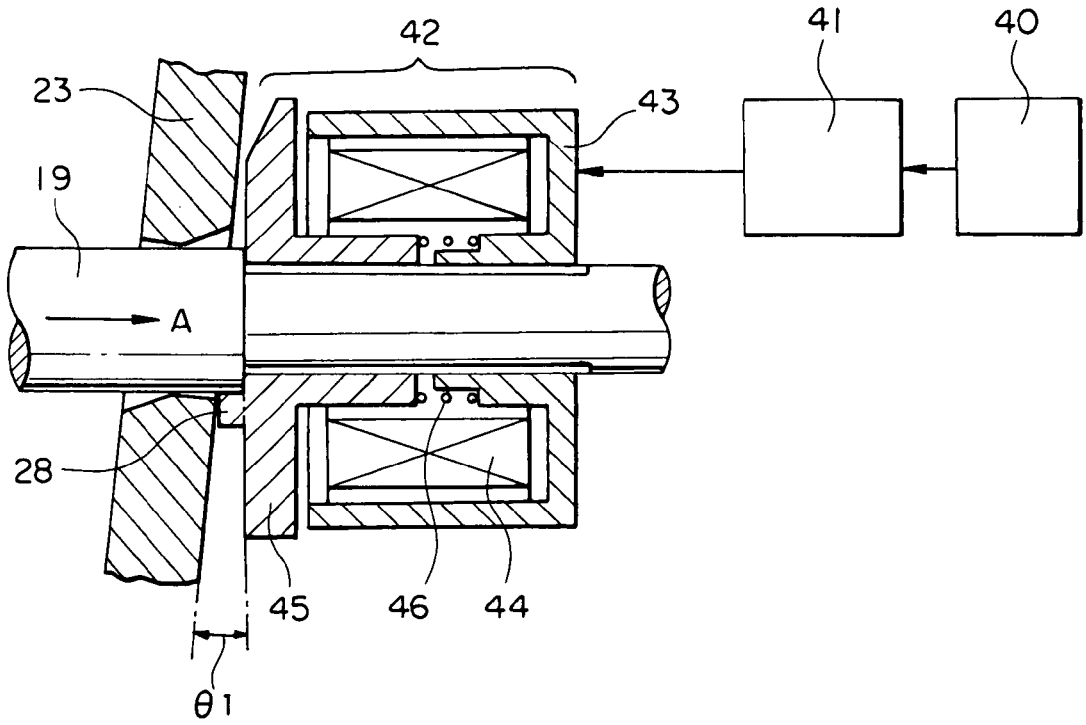
FIG. 4 is a sectional view illustrating a main portion of a compressor according to another embodiment, similar to FIG. 2.
Figure 5:
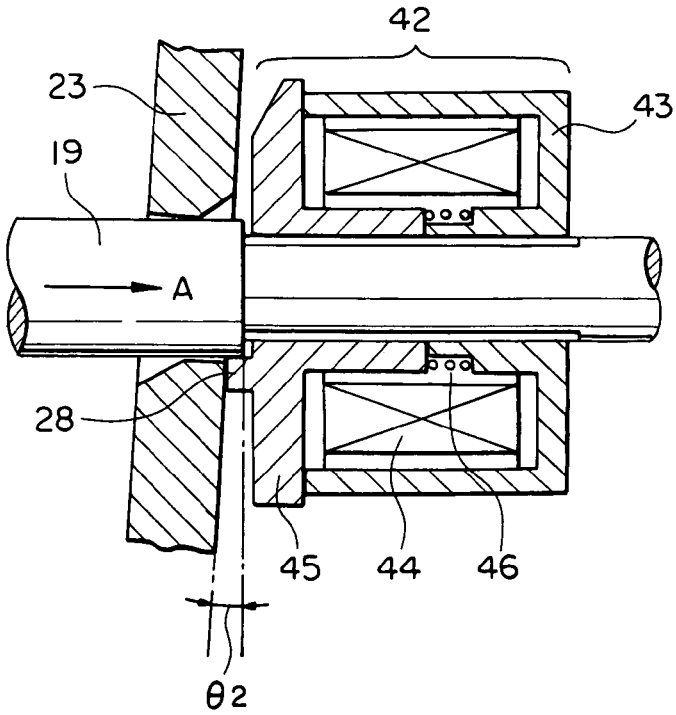
FIG. 5 is a view illustrating the main portion of FIG. 4, similar to FIG. 3.

Referring to FIG. 4 and 5, the driver comprises an electromagnetic solenoid 42 comprising a fixed magnetic core 43 fixedly mounted on the drive shaft 19, an electric wire coil 44 wound to the fixed magnetic core 43, and a movable magnetic core 45 having the stopper 28 and being movable with respect to the fixed magnetic core 43 in a direction of the drive axis. The driver further comprises a solenoid driver 41 connected to the electric wire coil 44 for energizing and disenergizing the electric wire coil 44 in response to the physical factor as detected by the detector 40. The detector 40 is a pressure sensor for detecting a pressure in the discharge chamber 15.

The electromagnetic solenoid 42 further comprises a core urging spring 46 for urging the movable magnetic core 45 so that the stopper 28 is positioned in the initial position. The solenoid driver 41 does not energize the electric wire coil 44 in a normal state, as shown in FIG. 4.

Referring to FIG. 5, the solenoid driver 41 energizes the electric wire coil 44 when the physical factor detected is determined to increase beyond a predetermined level of the factor, to move the stopper 28 from the initial position against the urging force of the core urging spring 46 in the direction of the drive axis. Therefore, the swash plate 23 is permitted to move from the initial angle to the predetermined minimum angle due to the urging force (A).

Figure 6:
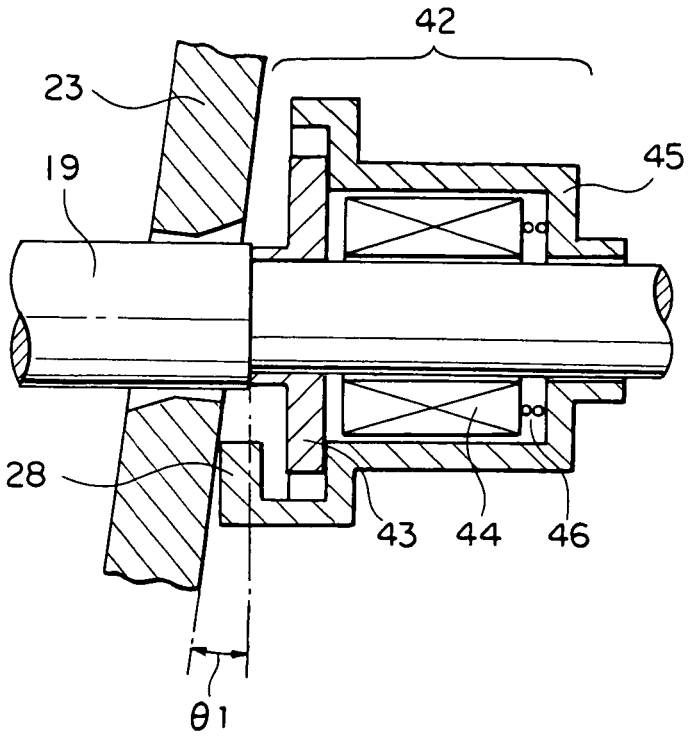
FIG. 6 is a sectional view illustrating a main portion of a compressor according to still another embodiment, similar to FIG. 2.
Figure 7:
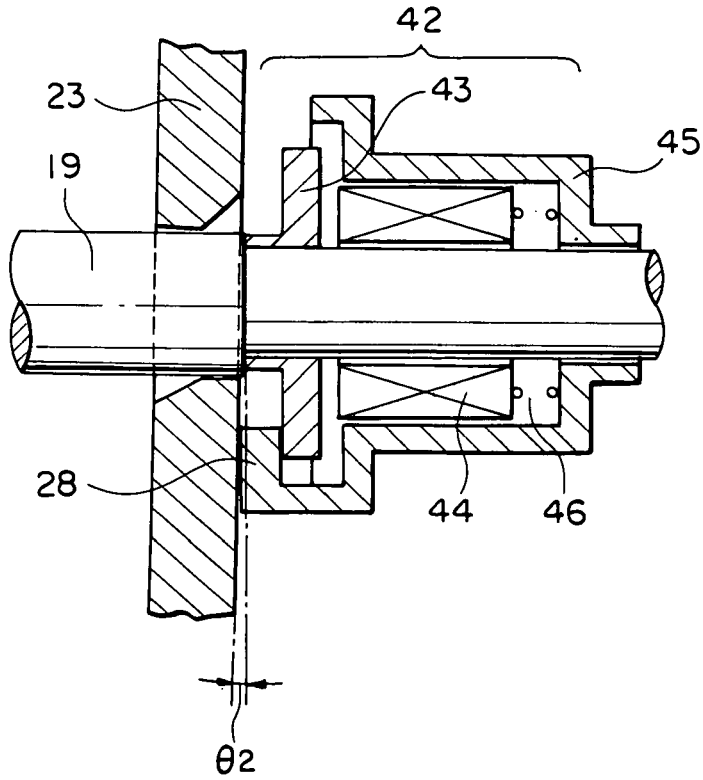
FIG. 7 is a view illustrating the main portion of FIG. 6, similar to FIG. 3.

In the embodiment shown in FIGS. 6 and 7, the similar components are shown by same reference numerals in FIGS. 2 and 3. The similar detector 40 and solenoid driver 41 are omitted for simplification of the drawing. In the embodiment, the core urging spring 46 urges the movable magnetic core 45 so that the stopper 28 is positioned at a remote position than the initial position as viewed from the rotor 22. The solenoid driver 41 energizes the electric wire coil 44 in a normal state to maintain the stopper 28 at the initial position against the core urging spring 46, as shown in FIG. 6.

Referring to FIG. 7, when the factor detected by the detector 40 exceeds a predetermined level, the solenoid driver 41 releases the energization of the electric wire coil 44. As a result, the stopper 28 is moved from the initial position in the direction of the drive axis by the urging force of the core urging spring 46. Therefore, the swash plate 23 is permitted to move from the initial angle to the predetermined minimum angle due to the urging force A.

Figure 8:
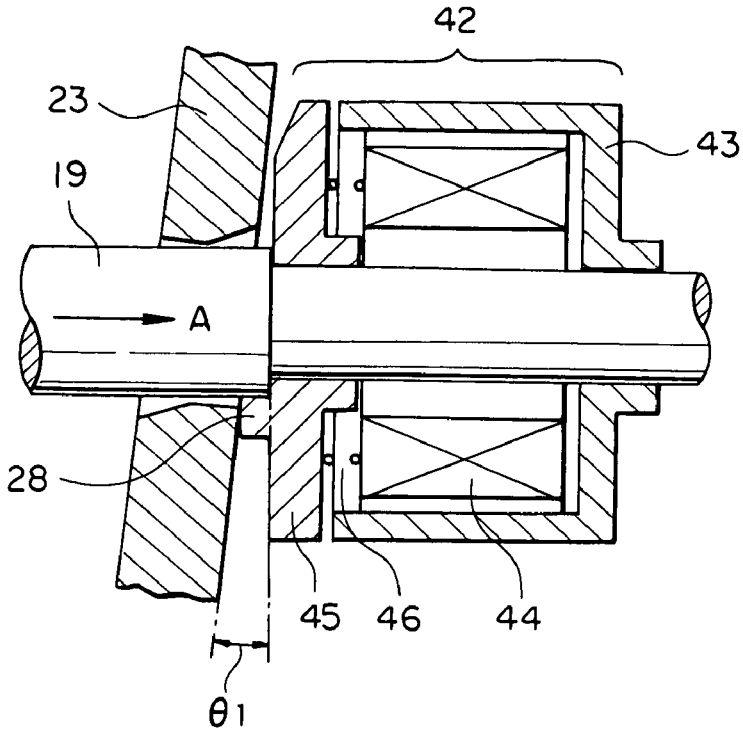
FIG. 8 is a sectional view illustrating a main portion of a compressor according to another embodiment, similar to FIG. 2.
Figure 9:
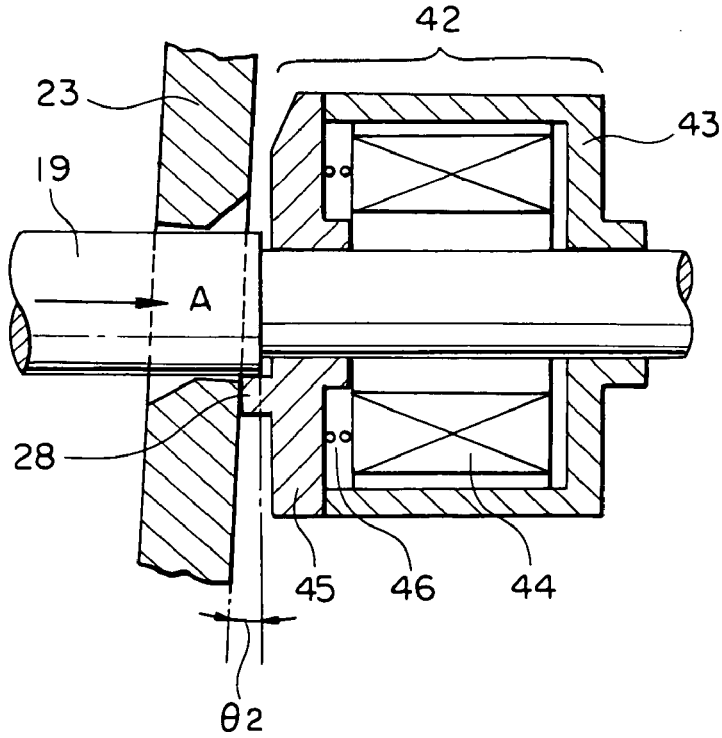
FIG. 9 is a view illustrating the main portion of FIG. 8, similar to FIG. 3.

The embodiment shown in FIGS. 8 and 9 are different in structure from, but same in operation with, that shown in FIGS. 2 and 3. In FIGS. 8 and 9, the similar components are shown by the same reference numerals in FIGS. 2 and 3, but detector 40 and solenoid driver 41 are also omitted for the purpose of simplification of the drawings. Accordingly, further description is omitted for the simplification of the description.

As the detector 40 in connection with embodiments of FIGS. 4-9, various sensors can be used for detecting physical factor corresponding to the compression work of the compressor 10.

The detector 40 can be a pressure sensor for detecting a difference in pressure between the discharge chamber 15 and the suction chamber 14.

The detector 40 can be a temperature sensor for detecting a temperature of the compressor 10.

The compressor 10 is charged therein with lubricating oil. Therefore, the detector 40 can be a temperature sensor for detecting a temperature of the compressor 10, or a viscosity sensor for detecting a viscosity of the lubricating oil.

The detector 40 can also be a temperature sensor for detecting an ambient temperature around the compressor 10.

The clutchless refrigerant compressor is used in an automotive air conditioning system. Therefore, the detector 40 can be a temperature sensor for detecting a temperature within a room of the automotive vehicle.

In the embodiments, there may often be a case where the stopper 28 is moved from the initial position backward to permit the swash plate 23 to move to the predetermined minimum angle during operation of the refrigerating circuit or the air conditioner. However, in the operation, the control valve or control mechanism operates to control the inclination angle of the swash plate 23 for the capacity control. The stopper 28 does not affect the capacity control at all.

The initial inclination angle can be set as desired, by selecting the initial position of the stopper 28. Therefore, it is easy to realize the smooth and rapid starting properties of the compressor

What is claimed is:

1. A clutchless refrigerant compressor of a variable displacement type comprising:

a compressor housing having therein a crank chamber, at least one cylinder bore, a suction chamber, and a discharge chamber, said suction chamber and a discharge chamber having an inlet port and an outlet port, respectively, for connecting the compressor to a refrigerating circuit;

at least one piston fitted into said at least one cylinder bore and reciprocating within said cylinder bore;

a drive shaft extending in the crank chamber in a direction parallel to said cylinder and said piston and rotatably born in the compressor housing, said drive shaft having an axial end portion protruding outward from the compressor housing, said axial end portion being for connecting an external driving source for receiving a driving power to rotate said drive shaft;

a rotor fixedly mounted on said drive shaft within said crank chamber to be rotatable together with said drive shaft;

a swash plate disposed around said drive shaft and connected to said rotor by a hinge connection at an angular position, as a hinge angular position, around said drive shaft so as to be rotatable together with said rotor and to be able to inclined from a plane perpendicular to a drive axis of said drive shaft, said swash plate making a nutating motion with an inclination angle by rotation together with said rotor, the inclination angle of said swash plate being variable between a predetermined minimum angle approximately equal to a zero angle and predetermined maximum angle;

a connecting mechanism connecting said swash plate to said piston for converting said nutating motion of said swash plate to reciprocating motion of said piston;

a control mechanism for controlling said inclination angle of said swash plate together or against said urging member by adjusting a pressure within said crank chamber to thereby control the displacement of said compressor;

determining means for determining the inclination angle of the swash plate to an initial angle when said drive shaft is stopped without being driven by the external driving source, the initial angle being selected larger than the predetermined minimum angle;

an urging member providing an urging force to urge the swash plate so that the inclination angle becomes the predetermined minimum angle, wherein said inclination angle determining means comprises a stopper mounted on said drive shaft at an initial position on the drive axis to stop said swash plate from changing in inclination due to the urging force when said drive shaft is not driven by said external driving source, for defining an initial angle of the inclination angle of the swash plate, said stopper being variable in the position on said drive axis; and releasing means for releasing the inclination angle determining means when compression work of the compressor is increased after said drive shaft is driven by the external driving source, wherein said releasing means comprises:

a detector for detecting a physical factor corresponding to compression work of said compressor;

a driver connected to said detector and said inclination angle determining means for, when said physical factor detected shows increase of said compression work, releasing said inclination angle determining means.

2. The clutchless refrigerant compressor as claimed in claim 1, wherein, when said physical factor detected shows increase of said compression work, said driver drives the stopper from said initial position in a direction of the drive axis to thereby permit said swash plate to move from said initial angle to the predetermined minimum angle due to the urging force from said urging member.

3. The clutchless refrigerant compressor as claimed in claim 2, wherein said detector is a pressure sensor for detecting a pressure in the discharge chamber.

4. The clutchless refrigerant compressor as claimed in claim 2, wherein said detector is a pressure sensor for detecting a difference in pressure between the discharge chamber and the suction chamber.

5. The clutchless refrigerant compressor as claimed in claim 2, wherein said detector is a temperature sensor for detecting a temperature of the compressor.

6. The clutchless refrigerant compressor as claimed in claim 2, wherein said compressor is charged therein with lubricating oil, and said detector is a temperature pressure sensor for detecting a temperature of the compressor.

7. The clutchless refrigerant compressor as claimed in claim 2, wherein said compressor is charged therein with lubricating oil, and said detector is a viscosity sensor for detecting a viscosity of the lubricating oil.

8. The clutchless refrigerant compressor as claimed in claim 2, wherein said detector is a temperature sensor for detecting an ambient temperature around the compressor.

9. The clutchless refrigerant compressor as claimed in claim 2, which is used in an automotive air conditioning system, wherein said detector is a temperature sensor for detecting a temperature within a room of the automotive vehicle.

10. The clutchless refrigerant compressor as claimed in claim 1, wherein said detector is a rotating speed sensor for sensing a rotating speed of said drive shaft, which results in the compression work of said compressor.

11. The clutchless refrigerant compressor as claimed in claim 1, further comprising a fixed ring fixedly mounted on said drive shaft at an axial position on a side opposite to said rotor with respect to said swash plate, said fixed ring having a side surface facing said swash plate, said side surface being inclined so that a first distance along the drive shaft from the side surface to said rotor at the hinge angular position is smaller than a second distance along the drive shaft from the side surface to said rotor at an angular position opposite to said hinge angular position, wherein said releasing means comprises:

a spring mounted on an outer surface of said fixed ring at an angular position corresponding to said hinge angular position; and a wedge-like ring having a wedge-shape section, said wedge-like ring being elastically supported by said spring and disposed around said drive shaft, said wedge-like ring having an inclined side surface corresponding to, and being in contact with, said side surface, said wedge-like ring having an unbalanced weight around said drive shaft so that a weight is smaller at a half of the wedge-like ring on the side of the hinge angular position than at the other half, the wedge-like ring being diametrically moved along said side surface of said fixed ring to a direction toward the opposite side of the hinge angular position against the supporting force of said spring by an centrifugal force caused by rotation together with said drive shaft, and wherein the stopper is formed as a protrusion at a position on the opposite side surface of said wedge-like ring, the stopper being moved in the direction of the drive axis by the movement of the wedge-shape ring by the centrifugal force.

12. The clutchless refrigerant compressor as claimed in claim 1, wherein said driver is an electromagnetic solenoid comprising a fixed magnetic core fixedly mounted on said drive shaft, an electric wire coil wound to the fixed magnetic core, and a movable magnetic core having the stopper and being movable with respect to the fixed magnetic core in a direction of the drive axis, said driver further comprising a solenoid driver connected to said electric wire coil for energizing and disenergizing the electric wire coil in response to said physical factor as detected by said detector.

13. The clutchless refrigerant compressor as claimed in claim 12, wherein said electromagnetic solenoid further comprises a core urging spring for urging the movable magnetic core so that said stopper is positioned in the initial position, and wherein said solenoid driver does not energize the electric wire coil in a normal state but energizes the electric wire coil when the physical factor detected is determined to increase beyond a predetermined level of the factor, to move the stopper from the initial position against the urging force of the core urging spring in the direction of the drive axis to thereby permit said swash plate to move from said initial angle to the predetermined minimum angle due to the urging force.

14. The clutchless refrigerant compressor as claimed in claim 12, wherein said electromagnetic solenoid further comprises a core urging spring for urging the movable magnetic core so that said stopper is positioned at a remote position than the initial position as viewed from the rotor, wherein said solenoid driver energizes the electric wire coil in a normal state to maintain the stopper at the initial position against the core urging force but releases the energization of the electric wire coil to move the stopper from the initial position in the direction of the drive axis by the urging force of the core urging spring to thereby permit said swash plate to move from said initial angle to the predetermined minimum angle due to the urging force.

* * * * *